US009345105B2

(12) United States Patent
De Jong et al.

(10) Patent No.: US 9,345,105 B2
(45) Date of Patent: May 17, 2016

(54) LIGHTING DEVICE WITH RF ANTENNA

(75) Inventors: Lambertus Adrianus Marinus De Jong, Son (NL); Marcus Joannes Van Den Bosch, Shanghai (CN); Joris Hubertus Antonius Hagelaar, Nuenen (NL); Vincent Stefan David Gielen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/239,936

(22) PCT Filed: Sep. 11, 2012

(86) PCT No.: PCT/IB2012/054712

§ 371 (c)(1),
(2), (4) Date: Feb. 20, 2014

(87) PCT Pub. No.: WO2013/042009

PCT Pub. Date: Mar. 28, 2013

(65) Prior Publication Data

US 2014/0204581 A1 Jul. 24, 2014

Related U.S. Application Data

(60) Provisional application No. 61/537,747, filed on Sep. 22, 2011.

(51) Int. Cl.

| | |
|---|---|
| ***F21V 29/00*** | (2015.01) |
| ***H01Q 1/26*** | (2006.01) |
| ***H05B 37/02*** | (2006.01) |
| ***F21V 7/00*** | (2006.01) |
| ***F21K 99/00*** | (2016.01) |
| ***H01Q 1/22*** | (2006.01) |
| ***F21V 23/04*** | (2006.01) |
| ***F21V 29/70*** | (2015.01) |

(52) U.S. Cl.
CPC ..... *H05B 37/02* (2013.01); *F21K 9/137* (2013.01); *F21K 9/54* (2013.01); *F21V 7/00* (2013.01); *F21V 23/045* (2013.01); *F21V 29/70* (2015.01); *H01Q 1/22* (2013.01); *H05B 37/0272* (2013.01)

(58) Field of Classification Search
CPC ..... F21K 9/137
See application file for complete search history.

(56) References Cited

U.S. PATENT DOCUMENTS

| | | | | |
|---|---|---|---|---|
| 7,521,872 | B2 | 4/2009 | Bruning | |
| 8,227,964 | B2 * | 7/2012 | Choi et al. | 313/46 |

(Continued)

FOREIGN PATENT DOCUMENTS

| | | | |
|---|---|---|---|
| CN | 201795315 | U | 4/2011 |
| JP | 2006080007 | A | 3/2006 |

(Continued)

*Primary Examiner* — Jong-Suk (James) Lee
*Assistant Examiner* — Eric T Eide
(74) *Attorney, Agent, or Firm* — Meenakshy Chakravorty

(57) ABSTRACT

The present invention relates to a lighting device (1). The lighting device comprises a light source (7) arranged at a base (2) of the lighting device, the light source having a main forward emission direction (12). The lighting device further comprises a radio frequency, RF, antenna (10) configured to receive signals for controlling the lighting device and a reflector (9) arranged to reflect light from the light source laterally and backwardly. The RF antenna is arranged at the reflector. The present invention is advantageous in that the RF reception of the lighting device is improved.

13 Claims, 2 Drawing Sheets

(56) References Cited

U.S. PATENT DOCUMENTS

| | | | | |
|---|---|---|---|---|
| 8,646,942 | B2 * | 2/2014 | Boomgaarden et al. | 362/249.02 |
| 2007/0007898 | A1 * | 1/2007 | Bruning | 315/34 |
| 2008/0158045 | A1 | 7/2008 | Teranishi et al. | |
| 2009/0303731 | A1 | 12/2009 | Chang | |
| 2012/0230034 | A1 * | 9/2012 | Boomgaarden et al. | 362/294 |
| 2012/0274208 | A1 * | 11/2012 | Chen et al. | 315/34 |

FOREIGN PATENT DOCUMENTS

| | | | |
|---|---|---|---|
| JP | 20080204922 | A | 9/2008 |
| JP | 2009026213 | A | 2/2009 |
| WO | 0115351 | A1 | 3/2001 |
| WO | 2005024898 | A2 | 3/2005 |
| WO | 2010140136 | A1 | 12/2010 |
| WO | 2012011030 | A1 | 1/2012 |

* cited by examiner

LIGHTING DEVICE WITH RF ANTENNA

This application is the U.S. National Phase application under 35 U.S.C. §371 of International Application No. PCT/2012/054712, filed Sep. 11, 2012, which claims the benefit of U.S. Provisional Patent Application No. 61/537,747 filed Sep. 22, 2011. These applications are hereby incorporated by reference herein.

FIELD OF THE INVENTION

The present invention generally relates to the field of lighting devices which can be remotely controlled with radio frequency, RF, signals.

BACKGROUND OF THE INVENTION

Remote control of lighting devices provides ease of use as e.g. the light can be remotely switched on and off and the light intensity level can be remotely dimmed or adjusted in some other way. A technique used for remote control of lighting devices is RF signals, which is advantageous in that a lighting device can be controlled from around a corner and through walls. Whether parts of the lighting device potentially shadow the RF signals needs to be considered when arranging an RF antenna in a lighting device. An LED based lighting device generally comprises a metal heat sink for cooling the LEDs and the driving electronics, which heat sink normally also forms the base and frame for the lighting device. Placement of the RF antenna in the heat sink has the drawback that the heat sink, which is made of electrically conductive material (metal), shields (or shadows) the RF antenna, whereby the RF reception at the lighting device is greatly reduced.

WO 2010/140136 shows an LED based lighting device, wherein an RF antenna is arranged at least 2 mm away from the heat sink, thus allowing a wide RF communication angle while enabling the heat sink to be large enough to ensure efficient cooling.

SUMMARY OF THE INVENTION

It is with respect to the above concerns that the present invention has been made. An object of the present invention is to provide an alternative to the above-mentioned signaling technique and prior art. More specifically, it is an object of the present invention to provide a lighting device with an improved RF communication capability.

These and other objects of the present invention are achieved by means of a lighting device with the features defined in the independent claim. Preferable embodiments of the invention are characterized by the features set forth in the dependent claims.

Hence, according to the invention, a lighting device is provided. The lighting device comprises at least one light source arranged at a base of the lighting device, the light source having a main forward emission direction, and an RF antenna configured to receive signals for controlling the lighting device. The lighting device further comprises a reflector arranged to reflect light from the light source laterally and backwardly (with respect to the main forward emission direction). Further, the RF antenna is arranged at the reflector (e.g. on top of, along or in a cavity formed by the reflector).

By the term "main forward direction" it is meant a direction being parallel with the optical axis of the light source and pointing away from the light source. Clearly, the reflector may have a shape allowing backward-lateral reflection even when a plurality of light sources—with non-parallel forward directions—are present.

The present invention is based on the idea of arranging the RF antenna for remote control of the lighting device at a reflector adapted to improve the luminous intensity distribution of the lighting device. Hence, the reflector serves as a support for the RF antenna, thereby supporting the RF antenna at a sufficient distance from the base of the lighting device. As the RF antenna is spatially separated from the base at which the driving electronics, the heat sink or any other potentially disturbing or shielding components are arranged, the RF reception of the lighting device is improved. The improved RF reception also provides for a reduction of the power required for the RF communication. Further, the RF antenna has a reduced influence on the illumination pattern (or light distribution) of the lighting device as the RF antenna may be arranged such that it does not shadow, or in any other way influence, the light from the light source. For instance, the antenna may be arranged on a non-illuminated side of the reflector. Instead, the light distribution of the lighting device is defined by the reflector and the light source. In fact, the RF antenna may have a reduced effect on the appearance of the lighting device as it may be concealed in the reflector.

Further, the present invention is advantageous in that the heat sink may be designed without particular regard to RF control, thereby enabling use of the same heat sink design for RF products as for non-RF products, which reduces manufacturing costs. Thus, with the present invention, the heat sink design is independent of the RF antenna. According to an aspect of the invention, two lighting devices, one with and one without RF antenna, can be manufactured using the same design except for the RF antenna itself.

Further, the present invention is advantageous in that the base and frame (or housing) of the lighting device is allowed to be entirely made of metal, whereby an improved thermal performance is achieved for the lighting device. Thus, neither the base nor the frame has to be made partly of plastic to allow reception of RF signals at the RF antenna.

The present invention is also advantageous in that the reflector—while allowing unobscured RF-communication—provides an improved omni-directional spreading of the light, whereby the light distribution of the lighting device better resembles that of an incandescent light source. In particular in LED based lighting devices, the light sources provide a directed light with a higher light intensity forwardly than laterally and backwardly. With the present invention, light from the light source is directed such that the light intensity laterally and backwardly is increased. With the present invention, the RF communication angle is increased while the luminous intensity distribution is more uniform for the lighting device.

According to an embodiment of the present invention, the reflector may extend from the base (substantially in the forward direction), which is advantageous in that any physical communication between the RF antenna and the base can be covered (or concealed) by the reflector (with respect to the light from light source). Hence, the influence on the light distribution of such a physical communication is reduced. Further, a plurality of light sources may be arranged at the base around the reflector, thereby providing a more uniform luminous intensity distribution.

In an embodiment of the invention, the lighting device may further comprise a wired communication line, such as a cable, arranged to transmit signals between the RF antenna and the base, which is advantageous in that the communication between the RF antenna and the driving electronics in the base is facilitated. Further, the wired communication line may extend along the reflector extending from the base. The wired communication line may for instance be arranged inside an inner chamber, separate from the light source, that the reflector defines, which is advantageous in that the reflector conceals the wired communication line from the light from the light source.

In an embodiment of the invention, the RF antenna may be arranged at a side of the reflector facing away from the light source, whereby the RF antenna's influence on the reflection of light from the light source is reduced.

In an embodiment of the invention, the reflector may be tapered towards the base, which is advantageous in that it increases the light intensity laterally and backwardly, thereby improving the omni-directional spreading of the light (or evenness of the illumination profile).

In an embodiment of the invention, the lighting device may further comprise an envelope in which the light source is contained, wherein the envelope and the reflector together define a light mixing chamber. The envelope provides a protection for the light sources and the reflector, thereby making the lighting device more durable. Preferably, the envelope is at least partly transparent or frosted (diffused). Further, the light mixing chamber may be toroid (or donut) shaped, whereby the reflecting surface of the reflector preferably defines the radially inner/upper side of the toroid shape and the envelope defines the radially outer side of the toroid shape. The surface on the base on which the light source or light sources are arranged may constitute a further boundary segment of the envelope. In an embodiment, the reflector may extend from the base up to the envelope, thereby further improving the light distribution laterally and backwardly.

According to an embodiment of the present invention, driving electronics for driving the light source may be arranged in the base, away from the RF antenna positioned at the reflector. This reduces the risk of the driving electronics disturbing the RF communication through electromagnetic fields.

In an embodiment of the invention, the base may comprise a heat sink for cooling components arranged at the base, such as the light source and its driving electronics, thereby improving the thermal performance of the lighting device while reducing the risk of the heat sink disturbing the RF communication. The heat sink may be made of metal as it is spatially separated from the RF antenna.

Further objectives of, features of and advantages with the present invention will become apparent when studying the following detailed disclosure, the drawings and the appended claims. Those skilled in the art realize that different features of the present invention can be combined to create embodiments other than those described in the following or the claims.

BRIEF DESCRIPTION OF THE DRAWINGS

This and other aspects of the present invention will now be described in more detail, with reference to the appended drawings showing an embodiment of the invention.

The figures are schematic, not necessarily to scale, and generally only show parts which are necessary in order to elucidate the invention, wherein other parts may be omitted or merely suggested.

DETAILED DESCRIPTION

Figure 1:
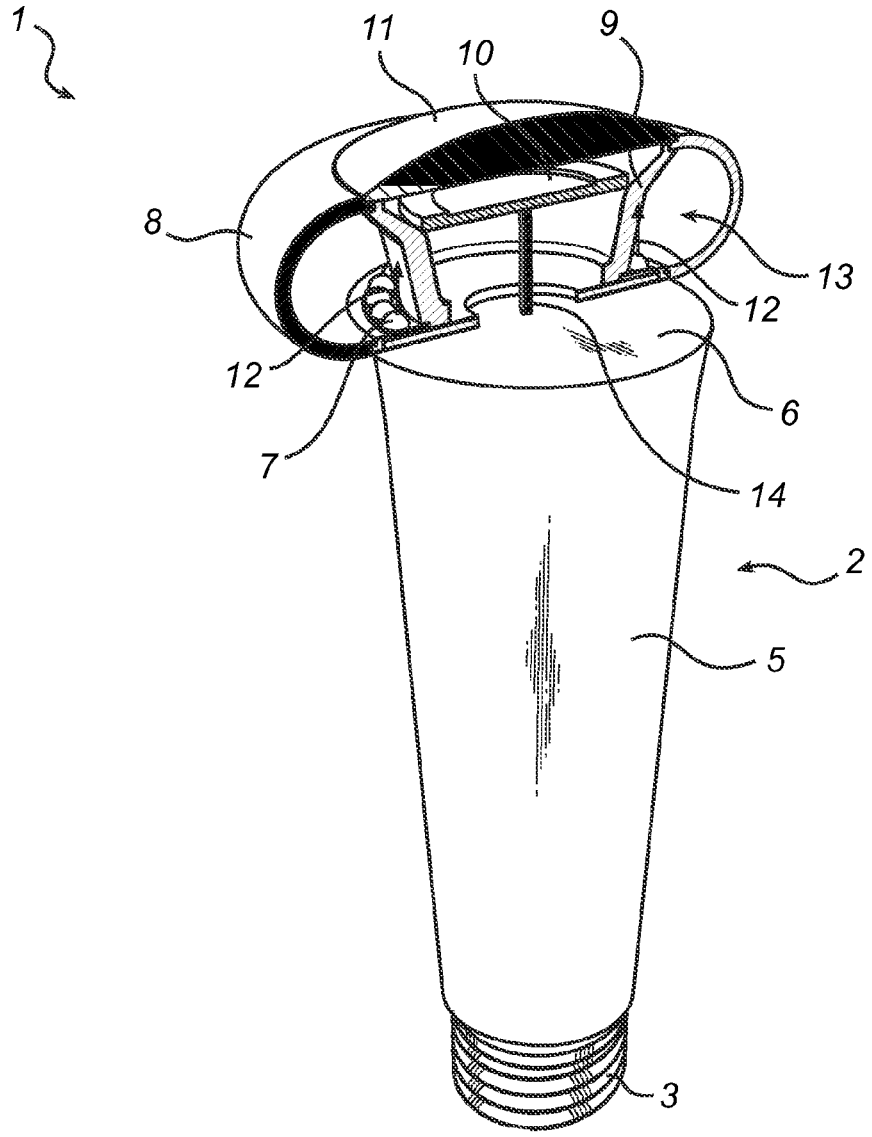
FIG. 1 shows a lighting device according to an embodiment of the present invention.
Figure 2:
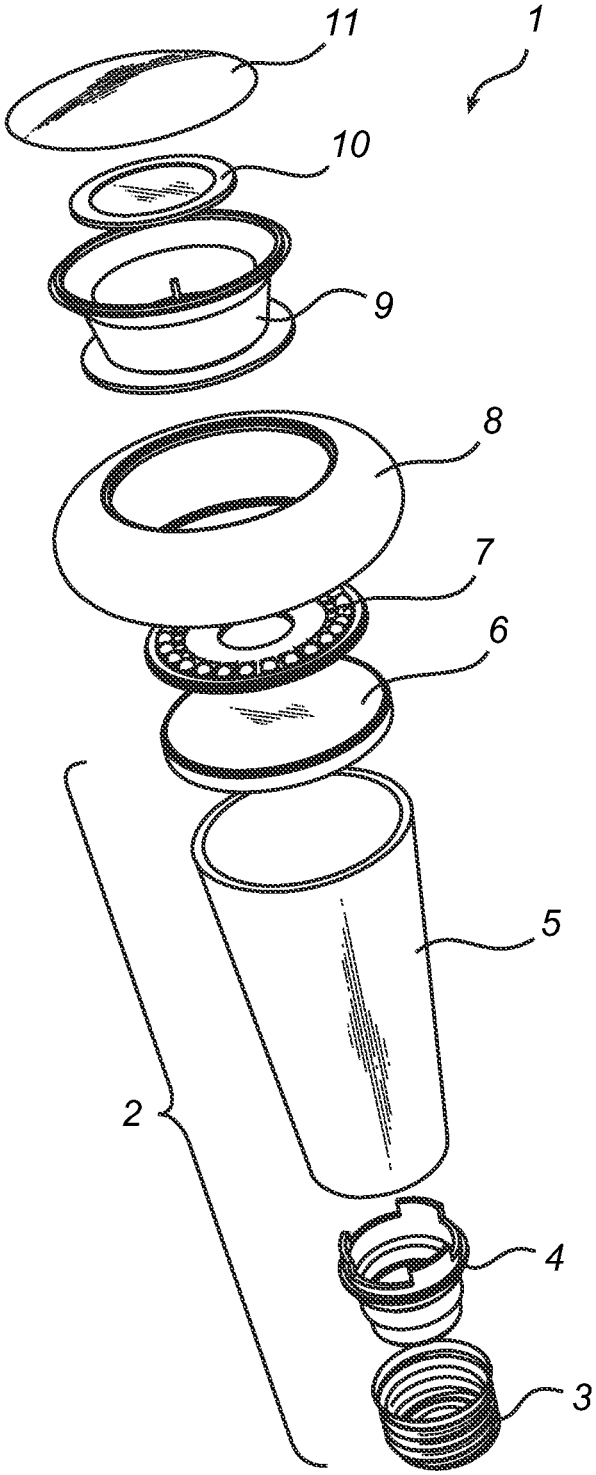
FIG. 2 is an exploded view of the lighting device in FIG. 1.

With reference to FIGS. 1 and 2, a lighting device according to an embodiment of the invention will be described.

FIG. 1 is a partially cross-sectional view of a lighting device 1, and FIG. 2 is an exploded view of the lighting device 1. The lighting device 1 comprises a base 2 including an end cap 3, such as a screw base, adapted to be arranged in a light fitting, a heat sink 5 and a shell 4 (shown in FIG. 2) for connecting the end cap 3 to the heat sink 5. The shell 4 may be used for securing the driving electronics (not shown) to the base 2, and the heat sink 5 may be arranged to enclose (or surround) the driving electronics. The base 2 further comprises a heat spreader 6 arranged at an upper end (opposite the end cap 3) of the base 2. Light sources 7, such as LEDs, are arranged at the heat spreader 6. The heat spreader 6 and the heat sink 5 are adapted to cool the light sources 7 and the driving electronics, and are preferably made of metal having a good thermal conductivity.

In this example, the light sources 7 have a common main forward emission direction indicated by arrows 12 in FIG. 1. The main forward emission direction is parallel with the optical axis of the lighting device 1 and points away from the base 2. In the present application, the main forward emission direction defines a forward direction of the lighting device.

The lighting device 1 further comprises a reflector 9 extending from the base 2 in the forward direction. The reflector 9 is tapered towards the base 2 so as to reflect light from the light sources 7 laterally and backwardly to increase the light intensity in those directions, thereby giving the lighting device 1 a more omni-directional illumination profile. An envelope 8 is arranged to enclose together with the reflector 9 and the base 2, the light sources 7. The envelope 8 may be at least partly transparent and optionally diffused to scatter the light from the light sources 7. The envelope 8 and the reflector 9 together define a light mixing chamber 13, as shown in FIG. 1. Preferably, the light mixing chamber 13 is toroid shaped and the light sources 7 are arranged uniformly distributed around the reflector 9 so as to provide an even circumferential light distribution. The reflector 9 extends up to the upper portion (i.e. the portion farthest away from the base 2) of the envelope 8.

In the reflector 9, an RF antenna 10 is arranged on a printed circuit board, PCB. The RF antenna 10 is adapted to receive (and optionally transmit) RF signals for controlling the lighting device 1. The RF antenna 10 may be arranged in the reflector 9 on a side of the reflector 9 facing away from the light sources 7, i.e. at the non-illuminated (non-reflecting) side of the reflector 9. For example, the RF antenna 10 may be arranged in an inner chamber of the reflector 9, separate from the light sources 7. Further, the RF antenna 10 is preferably arranged at that end of the reflector 9 which is farthest away from the base 2, such that it is located within the lighting device 1 substantially as far as possible from the base 2, which comprises metal and electric components that may disturb the RF communication. The RF antenna 10 is enclosed by the reflector 9 and a top cap 11. In contrast to prior art techniques, wherein the reflector is arranged in the base, the base 2 of the lighting device 1 according to the present embodiment of the invention does not need to be partly made of polymer or any other non-metal material for enabling RF reception. Instead, the most part of the base 2 may be made of metal, which is relatively cheap and provides an improved thermal performance of the lighting device 1.

The RF antenna 10 is arranged in communication with the driving electronics in the base 2 via a wired communication line 14, as shown in FIG. 1. The wired communication line 14 extends from the RF antenna PCB, inside the reflector 9 (i.e. separate from the light mixing chamber 13) and through the heat spreader 6 to the driving electronics comprised in the heat sink 5.

In an alternative embodiment (not shown), the reflector may not extend from the base, but be shaped as a convex cap arranged in the top of the envelope opposite to the base. The wired communication line may then e.g. extend along the inside of the envelope down to the base or freely through the space between the reflector and the base.

While specific embodiments have been described, the skilled person will understand that various modifications and alterations are conceivable within the scope as defined in the appended claims. For example, the present invention may be applied not just in LED based lighting devices, but in any RF controlled lighting device with high cooling requirements.

The invention claimed is:

1. A lighting device comprising:

a light source arranged at a base of the lighting device, the light source having a main forward emission direction;

a radio frequency (RF) antenna configured to receive signals for controlling the lighting device; and a reflector, defining an inner surface and an outer surface, the outer surface being arranged to reflect light from the light source out of the lighting device laterally and backwardly with respect to the main forward emission direction, wherein the inner surface of the reflector faces away from the light source and defines an inner portion, and wherein the RF antenna is arranged within the inner portion of the reflector.

2. A lighting device as defined in claim 1, wherein the reflector extends from the base.

3. A lighting device as defined in claim 2, further comprising a plurality of light sources arranged at the base around the reflector.

4. A lighting device as defined in claim 1, further comprising a wired communication line (14) arranged to transmit signals between the RF antenna and the base.

5. A lighting device as defined in claim 4, wherein the wired communication line extends along the reflector.

6. A lighting device as defined in claim 1, wherein the reflector is tapered towards the base of the lighting device.

7. A lighting device as defined in claim 1, further comprising an envelope in which the light source is contained, wherein the envelope and the reflector together define a light mixing chamber.

8. A lighting device as defined in claim 7, wherein the light mixing chamber is toroid shaped.

9. A lighting device as defined in claim 7, wherein the reflector extends from the base up to the envelope, such that the forward endpoints of the reflector and the envelope meet.

10. A lighting device as defined in claim 1, further comprising driving electronics for driving the light source are arranged in the base.

11. A lighting device as defined in claim 1, further comprising the base comprises a heat sink for cooling components arranged at the base.

12. A lighting device as defined in claim 11, wherein the heat sink is made of metal.

13. A lighting device as defined in claim 1, wherein the RF antenna is enclosed by the reflector and a top cap.

* * * * *